US007958836B2

(12) United States Patent
Borgund

(10) Patent No.: US 7,958,836 B2
(45) Date of Patent: Jun. 14, 2011

(54) STABILIZING CHAMBER FOR USE WITH A MOBILE OFFSHORE UNIT

(75) Inventor: Sven Borgund, Borgen (NO)

(73) Assignee: Aker Marine Contractors Inc., Houston, TX (US)

( * ) Notice: Subject to any disclaimer, the term of this patent is extended or adjusted under 35 U.S.C. 154(b) by 0 days.

(21) Appl. No.: 12/114,434

(22) Filed: May 2, 2008

(65) Prior Publication Data

US 2009/0272308 A1 Nov. 5, 2009

(51) Int. Cl.
*B63B 35/44* (2006.01)

(52) U.S. Cl. ..... 114/264; 405/205; 405/206

(58) Field of Classification Search ..... 114/264, 114/266, 267; 405/205, 206, 223.1, 224, 405/195.1, 209
See application file for complete search history.

(56) References Cited

U.S. PATENT DOCUMENTS

| | | | | |
|---|---|---|---|---|
| 2,394,764 | A * | 2/1946 | Greulich | 114/267 |
| 2,581,098 | A * | 1/1952 | Guenzel | 405/206 |
| 2,938,352 | A * | 5/1960 | Knapp et al. | 114/264 |
| 3,054,267 | A * | 9/1962 | Alcorn et al. | 405/209 |
| 3,610,193 | A * | 10/1971 | Lacy et al. | 114/265 |
| 3,837,309 | A * | 9/1974 | Biewer | 114/265 |
| 6,132,143 | A * | 10/2000 | Hovinga et al. | 405/206 |
| 6,206,614 | B1 | 3/2001 | Blevins et al. | |
| 6,503,023 | B2 * | 1/2003 | Huang et al. | 114/264 |
| 7,033,115 | B2 * | 4/2006 | Huang et al. | 114/264 |
| 2008/0190346 | A1 * | 8/2008 | Krehbiel et al. | 114/264 |

FOREIGN PATENT DOCUMENTS

| | | | |
|---|---|---|---|
| WO | 03-078241 | A2 | 9/2003 |
| WO | 2004-110855 | A2 | 12/2004 |

OTHER PUBLICATIONS

International Search Report dated Dec. 17, 2009 (9 pages).
International Preliminary Report on Patentability for Application No. PCT/US2009/042530 dated Nov. 11, 2010 (5 pages).

* cited by examiner

*Primary Examiner* — Lars A Olson
(74) *Attorney, Agent, or Firm* — Osha Liang LLP

(57) ABSTRACT

A stabilizing chamber to be used with a mobile offshore unit and a method of manufacturing and stabilizing therewith are disclosed. The stabilizing chamber includes a housing configured to removably receive and retain fluid therein, a first support, and a second support. The first and second supports are attached to the same side of the housing, and at least one of the supports is configured to support the weight of the stabilizing chamber. These supports are then configured to removably connect with the mobile offshore unit. The housing of the stabilizing chamber may be filled with fluid to at least partially submerge the stabilizing chamber. After fluid is received within the stabilizing chamber, the stabilizing chamber may be disconnected from the mobile offshore unit.

23 Claims, 7 Drawing Sheets

STABILIZING CHAMBER FOR USE WITH A MOBILE OFFSHORE UNIT

BACKGROUND OF DISCLOSURE

1. Field of the Disclosure

Embodiments disclosed herein generally relate to a method and apparatus used for stabilizing a mobile offshore unit. More specifically, embodiments disclosed herein relate to an improved stabilizing chamber that is used with mobile offshore units, such as submersible rigs, semi-submersible rigs, and jackup rigs.

2. Background Art

As the search to find energy resources continues, the increased demands in energy and decreased amounts of energy resources have required the exploration and production of the energy resources to be moved into more remote locations. For example, to find substantial reservoirs having energy resources, exploration has moved into remote geological offshore locations, such as bays, oceans, and seas. As drilling operators and engineers are well aware, these offshore locations present many problems that are not common with drilling on land.

To facilitate the exploration and production of energy reservoirs within the offshore locations, many different types of mobile offshore units have been developed. These mobile offshore units are generally self-contained floatable or floating drilling machines, in which the units may be transported to the offshore locations for production of energy sources. Examples of mobile offshore units include submersible production and/or drilling rigs, semi-submersible production and/or drilling rigs, and jackup rigs, amongst other various production and drilling rigs.

A submersible rig usually includes a floating vessel having a platform that is primarily supported on large float-like or pontoon-like structures. These structures are submerged below the sea surface, and once the submersible drilling rig is at the desired location, the submersible drilling rig is flooded with water until resting on the seafloor. Similarly, a semi-submersible rig also includes a floating vessel having a platform primarily support by large float-like or pontoon-like structures. However, a semi-submersible rig, when flooded with water, does not rest on the seafloor. Instead, the semi-submersible rig is anchored to the seafloor with long cables or chains. Because a semi-submersible rig does not need to be resting on the seafloor, the semi-submersible rig may be used in deeper offshore locations, as compared to the submersible rig.

The mobile offshore units, however, may be difficult to manage and control when in the offshore environment. For example, including the horizontal loads that are distributed upon a mobile offshore unit, the mobile offshore unit must also be able to withstand the forces from the waves, wind, and current. This delicate balance of all of these forces requires precision and increased stability for the mobile offshore unit.

Further, when the mobile offshore units are being flooded with water to submerge, the mobile offshore units have even more factors to consider. For example, as water is being received within the mobile offshore units, the center of gravity and the center of buoyancy of the mobile offshore unit are both rapidly changing. Furthermore, the operator must make sure that the different portions of the mobile offshore unit are being flooded at proportional rates. Otherwise, if one portion of the mobile offshore unit happens to flood more quickly and retain more water than another portion of the mobile offshore unit, this may cause the mobile offshore unit to tilt, and possibly even capsize.

Furthermore still, when the mobile offshore units are being transported to a desired offshore location for production of energy sources, the mobile offshore units need to maintain a relative velocity while withstanding the forces of the environment. This relative velocity requirement of the mobile offshore units further increases the degree of precision and stability that these mobile offshore units must have. Accordingly, there exists a need to increase the stability of a mobile offshore unit, particularly as the mobile offshore unit is in the process of submersion and/or transportation.

SUMMARY OF INVENTION

In one aspect, embodiments disclosed herein relate to a stabilizing chamber to be used with a mobile offshore unit. The chamber includes a housing having an upper end and a lower end, the housing configured to removably receive and retain fluid therein, an upper support attached adjacent to the upper end of the housing, and a lower support attached adjacent to the lower end of the housing. The upper support and the lower support are attached on the same side of the housing, the upper support and the lower support are adapted to removably connect with the mobile offshore unit, and the upper support is configured to support the weight of the chamber.

In another aspect, embodiments disclosed herein relate to a system to stabilize a mobile offshore unit. The system includes a stabilizing chamber having a housing configured to removably receive and retain fluid therein and a first support and a second support attached to the same side of the housing. The system further includes the mobile offshore unit having a first hull support and a second hull support attached to the same side of the mobile offshore unit. The first support of the stabilizing chamber is configured to removably connect with the first hull support of the mobile offshore unit, and the second support of the stabilizing chamber is configured to removably connect with the second hull support of the mobile offshore unit.

In yet another aspect, embodiments disclosed herein relate to a method of stabilizing a mobile offshore unit. The method includes providing a stabilizing chamber having a housing configured to removably receive and retain fluid therein, removably connecting a first support of the stabilizing chamber to a first hull support of the mobile offshore unit, and removably connecting a second support of the stabilizing chamber to a second hull support of the mobile offshore unit.

Further, in yet another embodiment, embodiments disclosed herein relate to a method of manufacturing a stabilizing chamber. The method includes providing a housing having an upper end and a lower end, the housing configured to removably receive and retain fluid therein, attaching an upper support adjacent to the upper end of the housing, and attaching a lower support adjacent to the lower end of the housing. The upper support and the lower support are attached on the same side of the housing, and the upper support is configured to support the weight of the stabilizing chamber Other aspects and advantages of the invention will be apparent from the following description and the appended claims.

DETAILED DESCRIPTION

Figure 1:
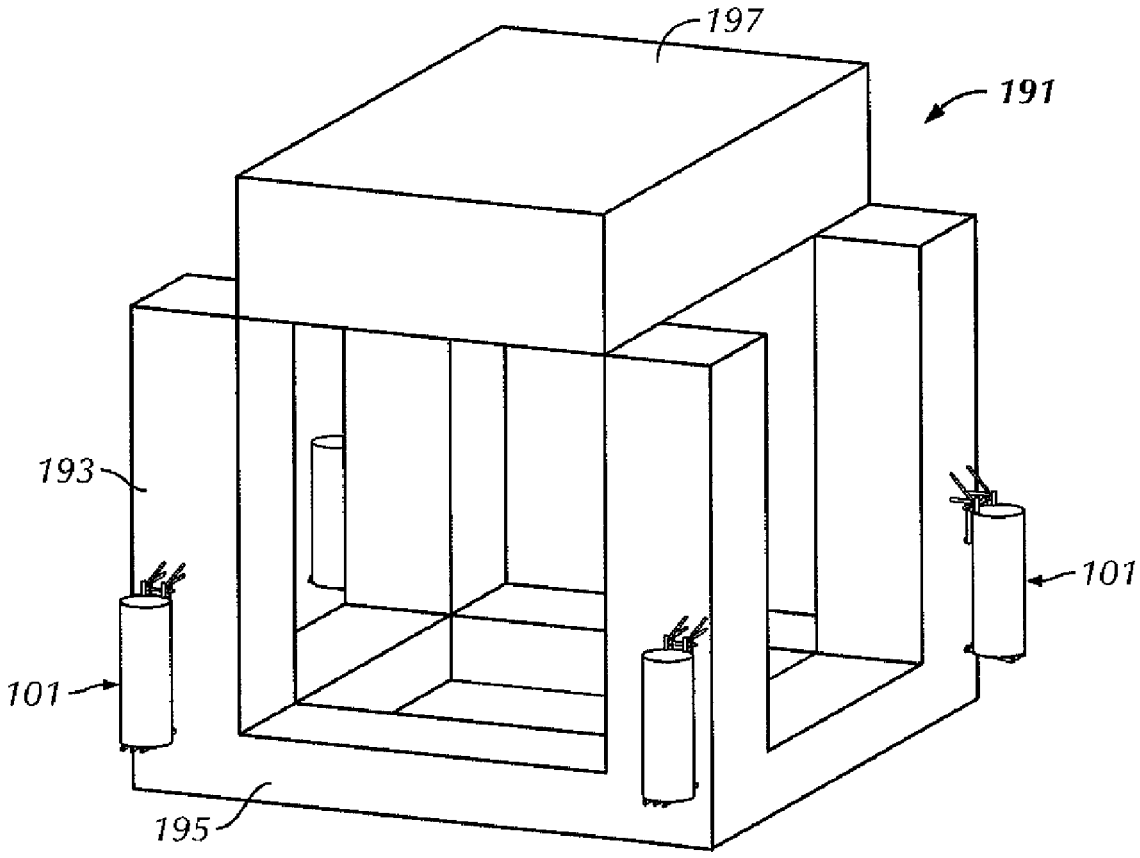
FIG. 1 shows a stylized perspective view of multiple stabilizing chambers and a mobile offshore unit in accordance with embodiments disclosed herein.

Specific embodiments of the present disclosure will now be described in detail with reference to the accompanying figures. Like elements in the various figures may be denoted by like reference numerals for consistency. Further, in the following detailed description of embodiments of the present disclosure, numerous specific details are set forth in order to provide a more thorough understanding of the invention. However, it will be apparent to one of ordinary skill in the art that the embodiments disclosed herein may be practiced without these specific details. In other instances, well-known features have not been described in detail to avoid unnecessarily complicating the description.

In one aspect, embodiments disclosed herein generally relate to a stabilizing chamber to be used with a mobile offshore unit. The stabilizing chamber includes a housing with an upper and a lower end, and the housing may removably receive and retain fluid therein. The stabilizing chamber then may removably connect with the mobile offshore unit. Specifically, the stabilizing chamber includes at least two supports, in which one of the supports engages one corresponding hull support of the mobile offshore unit, and the other of the supports slidably engages another corresponding hull support of the mobile offshore unit. The stabilizing chamber may also include a divider disposed therein, in which the divider forms a ballast compartment and a void compartment within the stabilizing chamber. The ballast compartment and the mobile offshore unit may each receive fluid therein. As the ballast compartment receives fluid, the stabilizing chamber stabilizes the mobile offshore unit as the mobile offshore unit moves downward with respect to the sea surface.

As used herein, "mobile offshore unit" refers generally to a self-contained floatable structure or floating drilling machine. Common mobile offshore units known in the art are submersible production and/or drilling rigs, semi-submersible production and/or drilling rigs, and jackup rigs, amongst other various production and drilling rigs. Accordingly, the present disclosure may be used with any mobile offshore unit known in the art.

Referring now to FIG. 1, a stylized perspective view of a system having multiple stabilizing chambers 101 removably connected to a mobile offshore unit 191 in accordance with embodiments disclosed herein is shown. In this embodiment, the mobile offshore unit 191 includes multiple columns 193, multiple pontoons 195, and a platform 197, in which the pontoons 195 are connected between the columns 193. Specifically, as shown, the mobile offshore unit 191 includes four columns 193 and four pontoons 195. However, those having ordinary skill in the art will appreciate that any number and combination of columns and pontoons may be used for the mobile offshore unit without departing from the scope of the present disclosure. Further, as shown, the mobile offshore unit 191 includes one stabilizing chamber 101 removably connected to each of the columns 193. However, those having ordinary skill in the art will also appreciate that, in other embodiments of the present disclosure, only one of the columns of the mobile offshore unit may have a stabilizing chamber removably connected thereto, or multiple stabilizing chambers may be removably connected to one or multiple columns of the mobile offshore unit.

The stabilizing chambers 101 are removably connected to the mobile offshore unit 191 to improve and increase the stability of the mobile offshore unit 191. As is known in the art, the mobile offshore unit 191, such as a semi-submersible drilling rig, may be transported to a desired offshore location and then receive fluid therein to anchor the mobile offshore unit 191 when the mobile offshore unit 191 is floating on the sea surface. For example, after reaching a desired offshore location, the columns 193 and/or pontoons 195 of the mobile offshore unit 191 may receive fluid therein, such as seawater, such that the mobile offshore unit 191 will move downward and be partially submerged with respect to the sea surface. The platform 197 of the mobile offshore unit 191 will stay above the sea surface, such as by about 100 ft (30 m) or more above sea level, but other portions, such as the pontoons 195 and lower ends of the columns 193, will be submerged. By submerging these portions of the mobile offshore unit 191, the effects from the sea and loading from the waves may be minimized, thereby increasing stability of the mobile offshore unit 191.

As the mobile offshore unit 191 is being transported to the desired offshore location, and/or as the mobile offshore unit 191 is moving downward and being submerged with respect to the sea surface, the stabilizing chambers 101 may increase the stability of the mobile offshore unit 191. For example, as the mobile offshore unit 191 is being transported, the center of gravity of the mobile offshore unit 191 is higher, as compared to after the mobile offshore unit 191 receives fluid therein. As such, the stabilizing chambers 101 may lower the center of gravity of the mobile offshore unit 191, thereby increasing stability of the mobile offshore unit 191.

Further, as the mobile offshore unit 191 receives fluid therein, the stabilizing chambers 101 may also receive fluid therein. This also increases the stability of the mobile offshore unit 191 by lowering the center of gravity of the mobile offshore unit 191, thereby helping prevent capsizing and other similar problems associated with submerging the mobile offshore unit 191. After a portion of the stabilizing units 101 have been submerged with the mobile offshore unit 101, such as having a majority portion of the stabilizing units 101 submerged with respect to the sea surface, the stabilizing units 101 may be disconnected from the mobile offshore unit 191 (discussed more below).

Figure 2B:
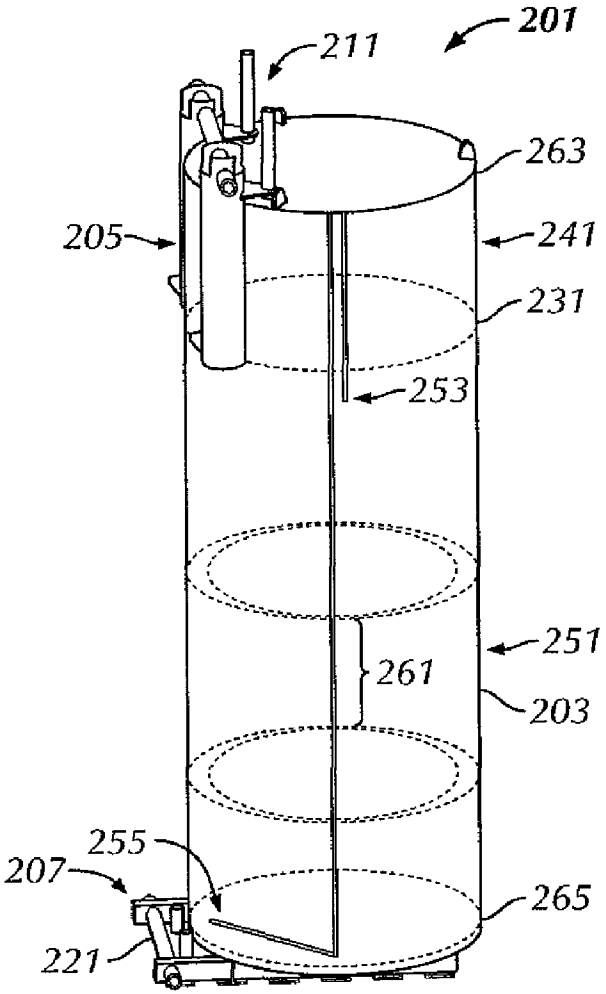
FIG. 2B shows a transparent view of the stabilizing chamber shown in FIG. 2A in accordance with embodiments disclosed herein.
Figure 2A:
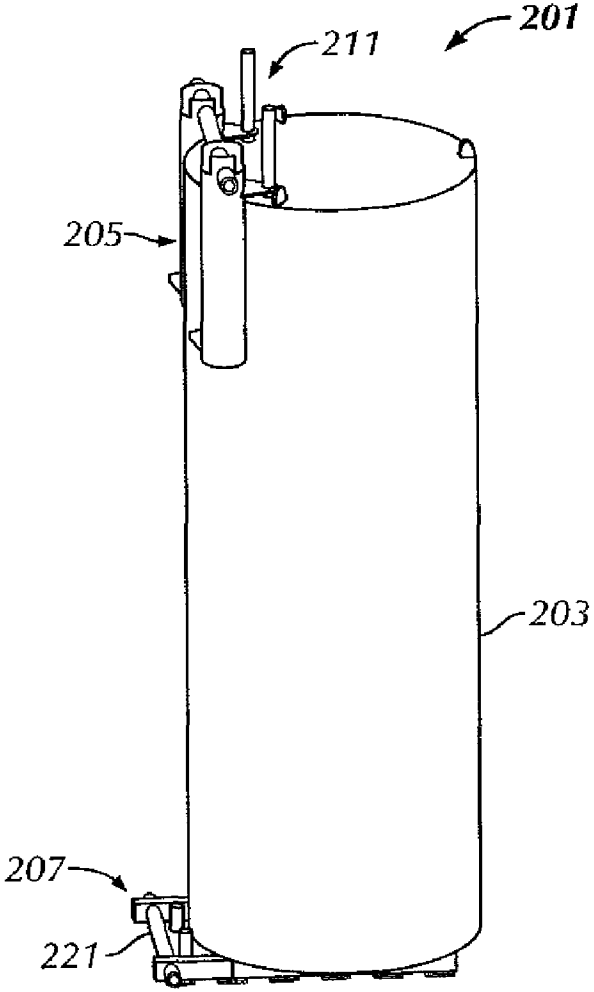
FIG. 2A shows a perspective view of a stabilizing chamber in accordance with embodiments disclosed herein.

Referring now to FIGS. 2A and 2B, multiple views of a stabilizing chamber 201 in accordance with embodiments disclosed herein are shown. Specifically, FIG. 2A shows a perspective view of the stabilizing chamber 201, and FIG. 2B shows a transparent view of the stabilizing chamber 201. As shown, the stabilizing chamber 201 includes a housing 203 with an upper end 205 and a lower end 207. In this embodiment, the housing is shown as having a cylindrical shape. However, those having ordinary skill in the art will appreciate that other shapes, such as a rectangular shape, may be used without departing from the scope of the present disclosure.

As shown, the stabilizing chamber 201 includes an upper support 211 and a lower support 221. The upper support 211 may be attached to the housing 203, such as adjacent to the upper end 205 of the housing 203, and the lower support 221 may be attached to the housing 203, such as adjacent to the lower end 207 of the housing 203. The upper support 211 and the lower support 221 are configured to removably connect with the mobile offshore unit. Specifically, the upper support 211 and the lower support 221 may removably connect with corresponding hull supports of the mobile offshore unit (discussed more below). When the upper support 211 and the lower support 221 removably connect with the mobile offshore unit, the upper support 211, at least, is able to support the entirety of the weight of the stabilizing chamber 201.

Referring now particularly to FIG. 2B, the stabilizing chamber 201 may further include a divider 231 disposed therein. The divider 231 is disposed within the housing 203 of the stabilizing chamber 201 such that the divider 231 forms multiple compartments 241, 251 within the housing 203. In this embodiment, the housing 203 is shown as having two compartments 241, 251 within the housing 203. However, those having ordinary skill in the art will appreciate that more than two compartments may be formed within the housing of the stabilizing chamber without departing from the scope of the present disclosure.

In this embodiment, the compartments 241, 251 formed within the stabilizing chamber 201 include a void compartment 241 and a ballasting compartment 251. The void compartment 241 is formed within the housing 203 such that the void compartment 241 is "water tight" and no undesired fluid may enter. As such, the void compartment 241 may prevent the stabilizing chamber 201 from completely filling with fluid.

The ballasting compartment 251 is then formed within the housing 203 such that the ballasting compartment may removably receive and retain fluid therein. For example, as shown, the ballasting compartment 251 may include one or more fluid connections 253, 255, in which the fluid connections 253, 255 provide fluid to the ballasting compartment 251. In this embodiment, the first fluid connection 253 is disposed adjacent to an upper end of the ballasting compartment 251, and the second fluid connection 255 is disposed adjacent to a lower end of the ballasting compartment 251. As such, the fluid connections 253, 255 may be used to provide different fluids and/or air to the ballasting compartment 251. Specifically, in one embodiment, the first fluid connection 253 may provide air to the ballasting compartment 251, and the second fluid connection 255 may provide water, such as seawater, to the ballasting compartment. The fluid connections 253, 255 enable the water level to be controlled as desired, and thereby the ballasting force, by providing the appropriate amounts of air and water to the ballasting compartment 251 of the stabilizing chamber 201.

The stabilizing chamber 201 may further include one or more ring stiffeners 261 disposed therein. Specifically, the ring stiffeners 261 may be disposed within the housing 203 of the stabilizing chamber 201, and the ring stiffeners 261 may be disposed adjacent the inner wall of the housing 203. Further, an upper end plate 263 disposed at the upper end 205 of the housing 203, and a lower end plate 265 disposed at the lower end 207 of the housing 203, may each also be stiffeners for the stabilizing chamber 201. As such, these may be used to provide rigidity and increase the structural integrity of the stabilizing chamber, thereby helping prevent structural failures of the stabilizing chamber under larger amounts of pressure.

The stabilizing chamber may be formed from any rigid material known in the art. Preferably, though, the stabilizing chamber is formed from, or includes, metal, such as steel. Assuming the stabilizing chamber is formed from steel and has a cylindrical shape, the stabilizing chamber may be about 49 ft (15 m) in height and about 17 ft (5.2 m) in diameter. As such, the void compartment of the stabilizing chamber may be about 11.5 ft (3.5 m) in height, and the ballasting compartment of the stabilizing chamber may be about 38 ft (11.5 m) in height. Further, with these above dimensions, the stabilizing chamber may have a wall thickness of about 0.80 in (20 mm). Those having ordinary skill in the art, though, will appreciate that these dimensions are used only as an exemplary embodiment, and other shapes, sizes, and dimensions may also be used for the stabilizing chamber without departing from the scope of the present disclosure.

Figure 3C:
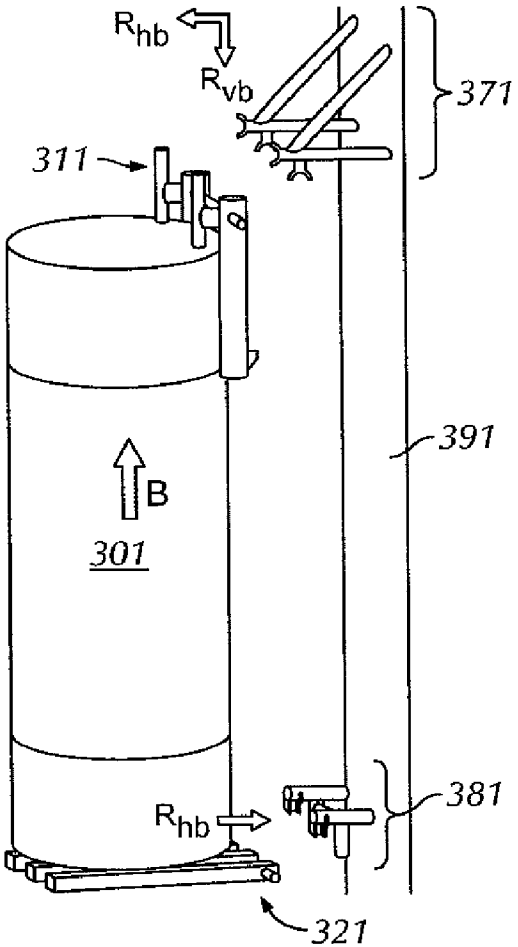
FIG. 3C shows another perspective view of the stabilizing chamber connecting with the mobile offshore unit shown in FIGS. 3A and 3B in accordance with embodiments disclosed herein.
Figure 3B:
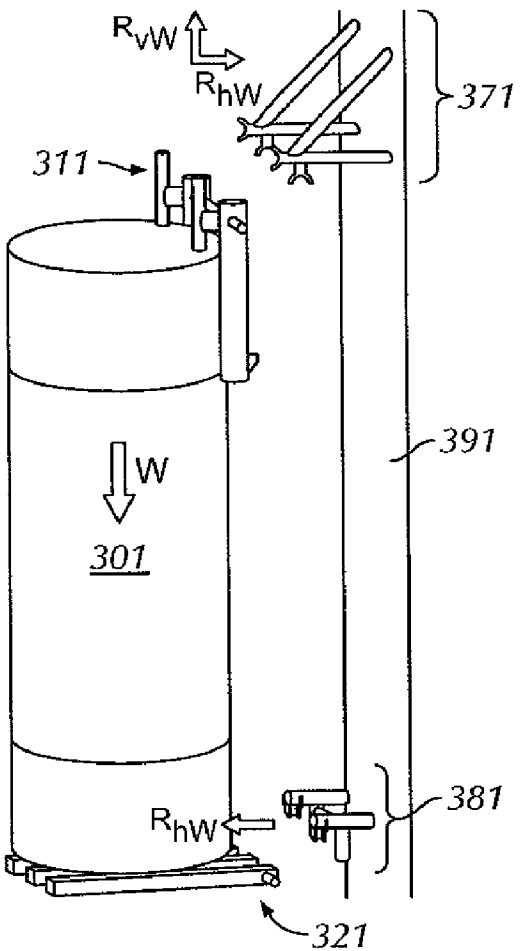
FIG. 3B shows another perspective view of the stabilizing chamber connecting with the mobile offshore unit shown in FIG. 3A in accordance with embodiments disclosed herein.
Figure 3A:
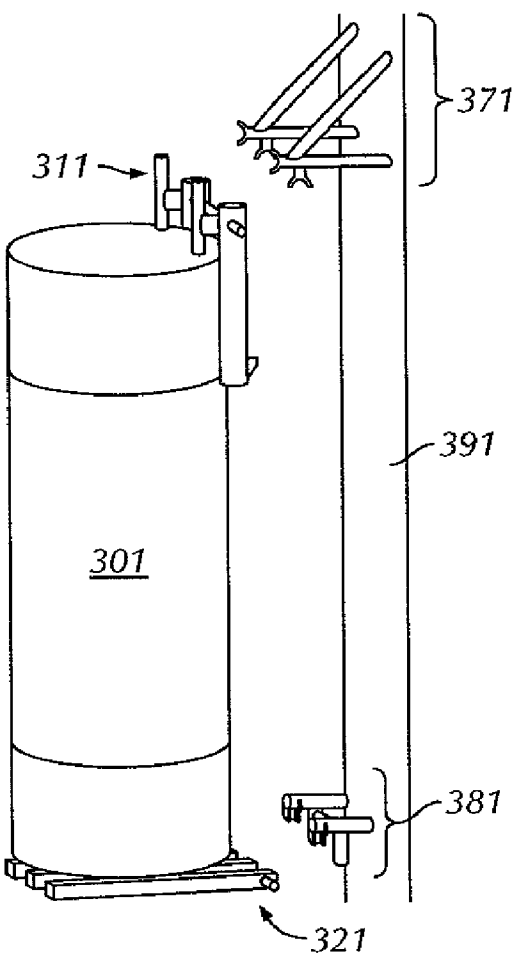
FIG. 3A shows a perspective view of a stabilizing chamber connecting with a mobile offshore unit in accordance with embodiments disclosed herein.

Referring now to FIGS. 3A-3C, multiple perspective views of a stabilizing chamber 301 removably connecting with a mobile offshore unit 391 in accordance with embodiments disclosed herein are shown. Specifically, FIG. 3A shows a detailed view of the stabilizing chamber 301 removably connecting with the mobile offshore unit 391, FIG. 3B shows a diagram of the resultant forces between the stabilizing chamber 301 and the mobile offshore unit 391 before the stabilizing chamber is submerged, and FIG. 3C shows a diagram of the resultant forces between the stabilizing chamber 301 and the mobile offshore unit 391 after the stabilizing chamber is submerged.

As shown, the stabilizing chamber 301 includes an upper support 311 and a lower support 321. The upper support 311 removably connects with an upper hull support 371 of the mobile offshore unit 391, and the lower support 321 removably connects with a lower hull support 381 of the mobile offshore unit 391. Specifically, when the upper support 311 removably connects with the upper hull support 371, the upper support 311 may engage the upper hull support 371. Further, when the lower support 321 of the stabilizing chamber 301 removably connects with the lower hull support 381 of the mobile offshore unit 391, the lower support 321 may slidably engage the lower hull support 381. As such, by using only the connection between the lower support 321 and the lower hull support 381, the stabilizing chamber 301 may move vertically (i.e., up-and-down) with respect to the mobile offshore unit 391, but the stabilizing chamber 301 may not substantially move horizontally (i.e., side-to-side) with respect to mobile offshore unit 391.

With the above-described engagement of the upper support 311 with the upper hull support 371 and the lower support 321 with the lower hull support 381, the upper support 311 and the upper hull support 371 must be able to support the entirety of the weight of the stabilizing chamber 301. Further, the upper support 311 and the upper hull support 371 must be able to receive forces transferred from the stabilizing chamber 301 in substantially all directions.

For example, as shown in FIG. 3B, before the stabilizing chamber 301 receives fluid therein or before the stabilizing chamber 301 is placed within the water, the weight W of the stabilizing chamber 301 acts vertically downward. As such, to support the stabilizing chamber 301, the upper hull support 371 must therefore be able to support a resultant upward vertical force $R_v$w equal to that of the weight W. Further, due to the arrangement of the stabilizing chamber 301 with the mobile offshore unit 391 and the moment that the stabilizing chamber 301 imparts, the upper hull support 371 must be able to support a resultant horizontal force $R_h$w pulling the stabilizing chamber 301, and the lower hull support 381 must be able to support a resultant horizontal force $R_h$w pushing the stabilizing chamber 301.

Further, as shown in FIG. 3C, after the stabilizing chamber 301 receives fluid therein or after the stabilizing chamber 301 is placed within the water, the buoyancy B of the stabilizing chamber 301 may the act vertically upward. As such, to support the stabilizing chamber 301, the upper hull support 371 must therefore be able to support a resultant downward vertical force $R_v$b equal to that of the buoyancy B. Furthermore, the upper hull support 371 must also be able to support a resultant horizontal force $R_h$b pushing the stabilizing chamber 301, and the lower hull support 381 must be able to support a resultant horizontal force $R_h$b pulling the stabilizing chamber 301. Thus, the upper support 311 of the stabilizing chamber 301 and the upper hull support 371 of the mobile offshore unit 391 must be able to receive and withstand forces transferred in substantially any direction (e.g., both vertical and horizontal directions), whereas the lower support 321 and the lower hull support 381 may only have to be able to receive and withstand forces transferred in the horizontal direction.

Figure 4A:
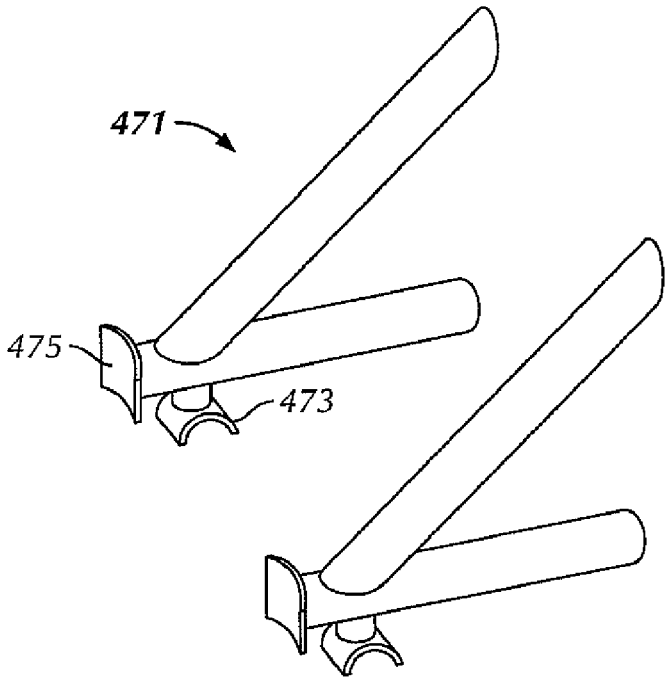
FIG. 4A shows a perspective view of an upper hull support in accordance with embodiments disclosed herein.
Figure 4B:
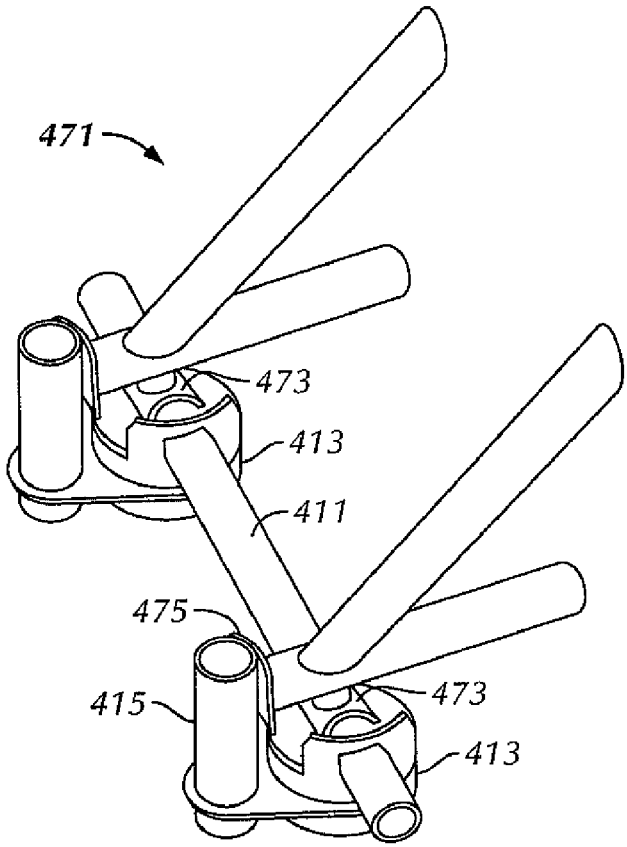
FIG. 4B shows a perspective view of an upper hull support connected with an upper support in accordance with embodiments disclosed herein.

Referring now to FIGS. 4A and 4B, detailed perspective views of an upper hull support 471 (FIG. 4A) and the upper hull support 471 removably connected with an upper support 411 (FIG. 4B) in accordance with embodiments disclosed herein are shown. In this embodiment, the upper support 411 (which attaches to the stabilizing chamber) may include one or more hook connection members 413 and one or more guiding connection members 415. Correspondingly, the upper hull support 471 (which attaches to the mobile offshore unit) may include one or more hook connection members 473 and one or more guiding connection members 475. As such, the hook connection members 413, 473 of the supports 411, 471 may engage with each other, and the guiding connection members 415, 475 may guide the supports 411, 471 into engagement.

Figure 4C:
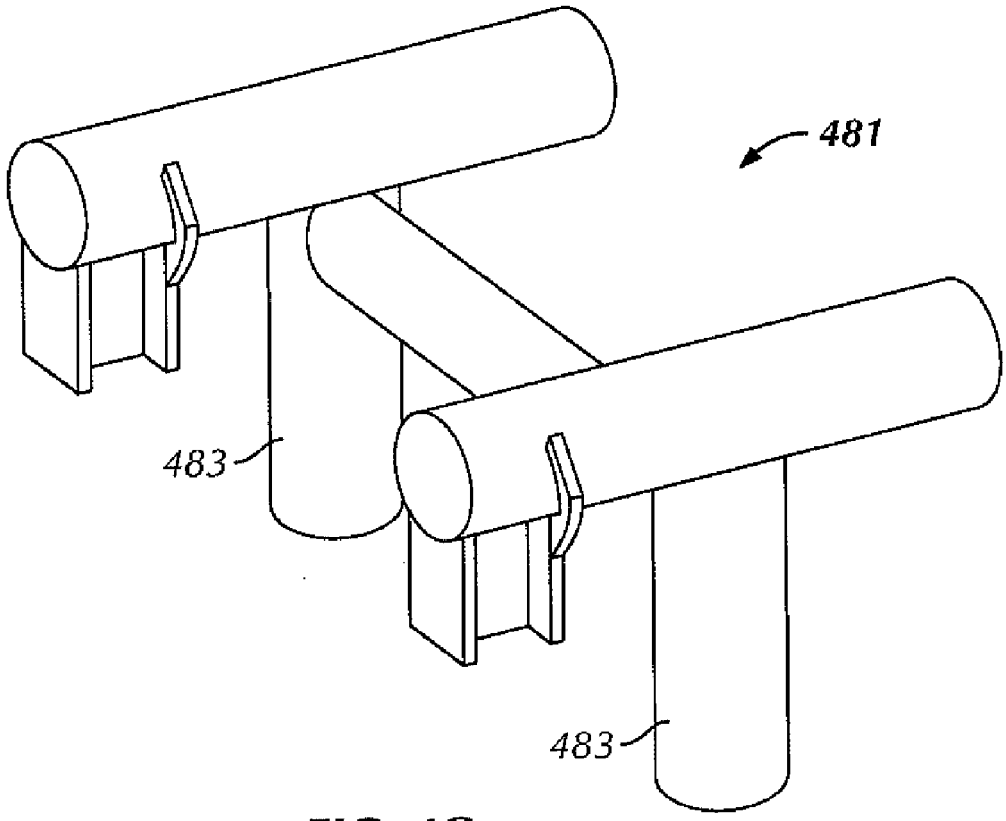
FIG. 4C shows a perspective view of a lower hull support in accordance with embodiments disclosed herein.
Figure 4D:
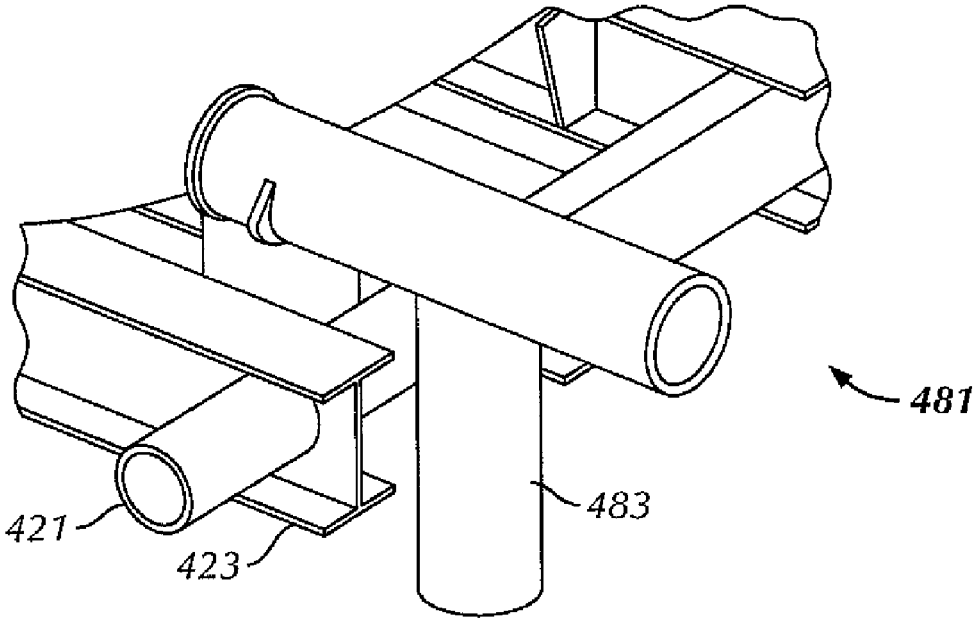
FIG. 4D shows a perspective view of a lower hull support connected with a lower support in accordance with embodiments disclosed herein.

Referring now to FIGS. 4C and 4D, detailed perspective views of a lower hull support 481 (FIG. 4C) and the lower hull support 481 removably connected with a lower support 411 (FIG. 4D) in accordance with embodiments disclosed herein are shown. In this embodiment, the lower support 421 (which attaches to the stabilizing chamber) may include one or more slidable connection members 423. Correspondingly, the lower hull support 481 (which attaches to the mobile offshore unit) may also include one or more slidable connection members 483. As such, the slidable connection members 423, 483 of the supports 421, 481 may slidably engage with each other. Further, as shown, the slidable connection members 423, 483 may limit and prevent the vertical movement in one direction of the stabilizing chamber with respect to the mobile offshore unit.

As shown in FIGS. 4A-4D, the upper support 411, the upper hull support 471, the lower support 421, and the lower hull support 481 may be formed or include a tubular frame. However, those having ordinary skill in the art will appreciate that the present disclosure is not so limited. For example, in another embodiment, rather than using a tubular frame, the supports may be formed or include rods, t-bars, or any other similar framing elements known in the art.

Figure 5:
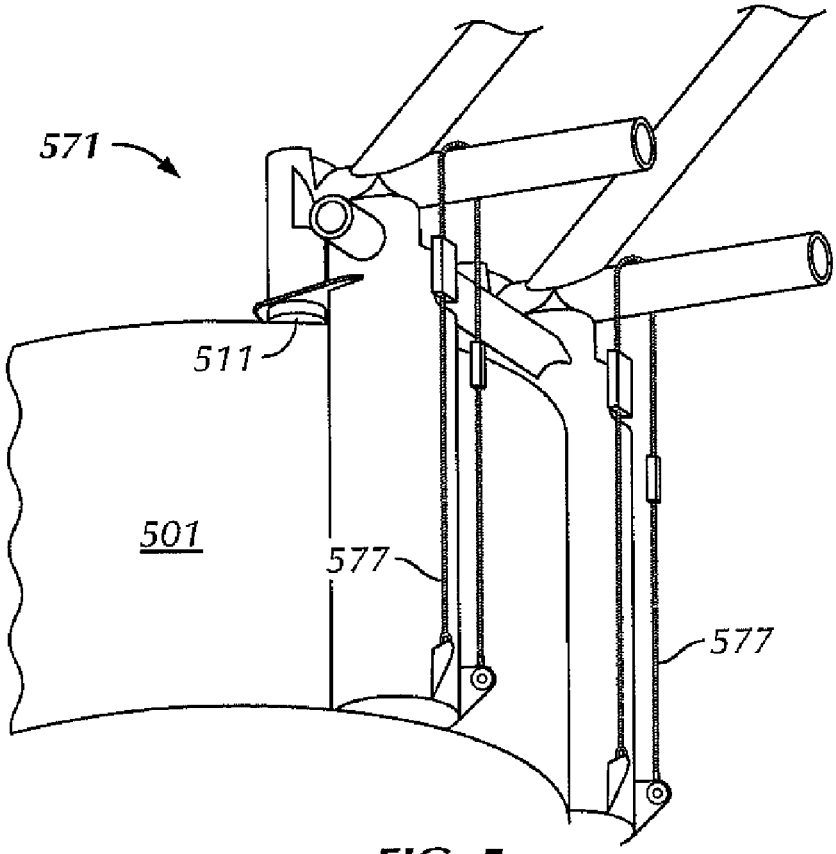
FIG. 5 shows a perspective view of a stabilizing chamber connecting with a mobile offshore unit in accordance with embodiments disclosed herein.

Referring now to FIG. 5, a detailed perspective view of an upper support 511 of a stabilizing chamber 501 removably connecting with an upper hull support 571 of a mobile offshore unit in accordance with embodiments disclosed herein is shown. In this embodiment, the upper support 511 and the upper hull support 571 are removably connected to each other with one or more suspension cables 577. As shown, the suspension cables 577 attach to the stabilizing chamber 501 and are disposed about the upper hull support 571. By maintaining tension within the suspension cables 577 then, the upper support 511 and the upper hull support 571 may maintain engagement with each other. In another embodiment, though, rather than attaching the suspension cables 577 to the stabilizing chamber 501, the suspension cables 577 may be attached to the mobile offshore unit. In such an embodiment, the suspension cables 577 may be disposed about the upper support 511.

Further, in another embodiment, rather than using the suspension cables 577, the upper support 511 and the upper hull support 571 may be connected to each other using other connection methods. For example, in another embodiment, one or more pins may be inserted through the upper support 511 and the upper hull support 571. As such, the pins may maintain engagement between the upper support 511 and the upper hull support 571. Accordingly, those having ordinary skill in the art will appreciate that other methods known in the art may be used to removably connect the upper support of the stabilizing chamber with the upper hull support of the mobile offshore unit.

Figure 6:
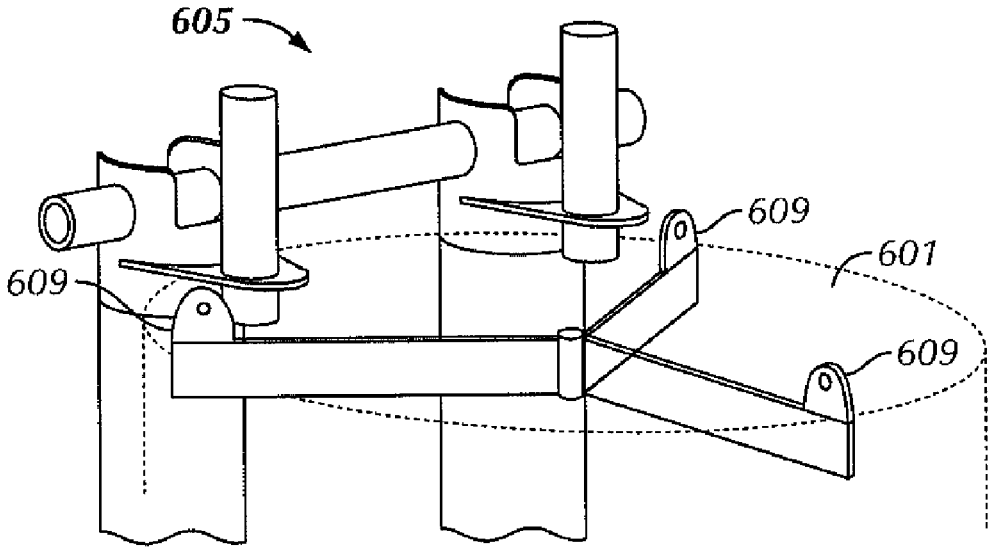
FIG. 6 shows a perspective view of a stabilizing chamber in accordance with embodiments disclosed herein.

Referring now to FIG. 6, a detailed perspective view of a stabilizing chamber 601 having one or more lifting connection members 609 attached thereto in accordance with embodiments disclosed herein is shown. The lifting connection members 609 are formed and attached to the stabilizing chamber 601 such that the stabilizing chamber 601 may be connected to a lifting device (not shown), such as a crane. This may facilitate removable connection of the stabilizing chamber 601 with the mobile offshore unit. In this embodiment, the lifting connection members 609 are attached adjacent to an upper end 605 of the stabilizing chamber 601. However, the present disclosure is not so limited, as the lifting connection members may be attached to any location of the stabilizing chamber. Further, in this embodiment, the lifting connection members 609 are shown as padeyes. However, again, the present disclosure is not so limited, as other lifting connection members, such as hooks or magnets, may be used without departing from the scope of the present disclosure.

Figure 7C:
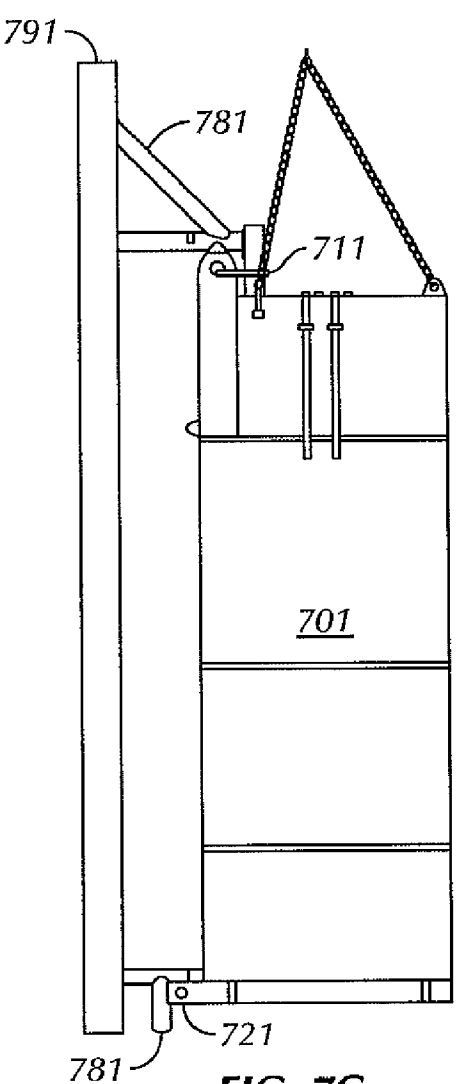
FIG. 7C shows another perspective view of the stabilizing chamber connecting with the mobile offshore unit shown in FIGS. 7A and 7B in accordance with embodiments disclosed herein.
Figure 7B:
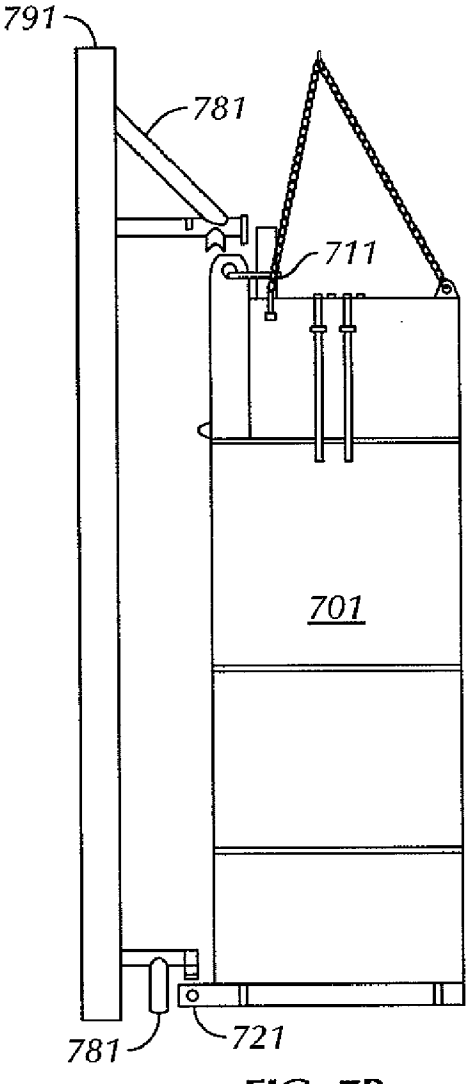
FIG. 7B shows another perspective view of the stabilizing chamber connecting with the mobile offshore unit shown in FIG. 7A in accordance with embodiments disclosed herein.
Figure 7A:
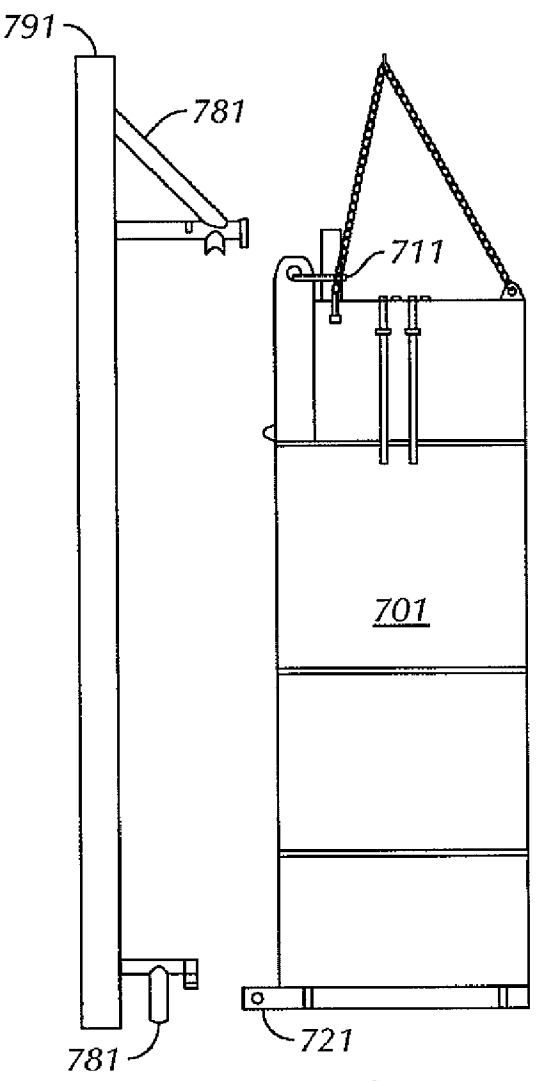
FIG. 7A shows a perspective view of a stabilizing chamber connecting with a mobile offshore unit in accordance with embodiments disclosed herein.

Referring now to FIGS. 7A-7C, multiple perspective views of a stabilizing chamber 701 removably connecting with a mobile offshore unit 791 in accordance with embodiments disclosed herein are shown. Specifically, FIG. 7A shows a perspective view of the stabilizing chamber 701 before removably connecting with the mobile offshore unit 791, FIG. 7B shows a perspective view of the stabilizing chamber 701 during the removably connecting with the mobile offshore unit 791, and FIG. 7C shows a perspective view of the stabilizing chamber 701 after removably connecting with the mobile offshore unit 791.

As shown in the sequence of FIGS. 7A-7C, the stabilizing chamber 701 is moved, such as by a lifting device, such that a lower support 721 of the stabilizing chamber 701 is positioned substantially vertically below or underneath a lower hull support 781 of the mobile offshore unit 791. Further, an upper support 711 of the stabilizing chamber 701 may also be positioned substantially vertically below or underneath an upper hull support 771 of the mobile offshore unit 791.

After the lower support 721 is positioned substantially below the lower hull support 771, the stabilizing chamber 701 may be vertically raised with respect to the mobile offshore unit 791. As such, when raised, the lower support 721 may slidably engage with the lower hull support 781, and the upper support 711 may engage with the upper hull support 771. As described above, when the upper support 711 and the upper hull support 771 engage each other, the supports 711, 771 may each have hook connection members and/or guide connection members to facilitate engagement.

After the stabilizing chamber 701 is vertically raised with respect to the mobile offshore unit 791, the upper support 711 may removably connect with the upper hull support 771, and the lower support 721 may removably connect with the lower hull support 781. For example, as described above, suspension cables may be used to removably connect the stabilizing chamber 701 with the mobile offshore unit 791, or pins may be used to removably connect the stabilizing chamber 701 with the mobile offshore unit 791. As such, in this arrangement, the upper support 711 and the upper hull support 771 must be able to support the entirety of the weight of the stabilizing chamber 701.

After removably connecting the stabilizing chamber to the mobile offshore unit, the mobile offshore unit may then be transported to a desired location. For example, assuming the mobile offshore unit is a semi-submersible drilling rig, the mobile offshore unit may be transported to a desired drilling location. As discussed above, the stabilizing chambers may increase the stability of the mobile offshore unit during transportation. Then, once at the desired location, the mobile offshore unit may receive fluid therein to anchor the mobile offshore unit when floating on the sea surface. The mobile offshore unit may receive fluid, such as seawater, in which the mobile offshore unit will move downward and be partially submerged with respect to the sea surface. As the mobile offshore unit is moving downward with respect to the sea surface, the stabilizing chamber may also receive fluid therein to increase the stability of the mobile offshore unit.

To receive fluid within the stabilizing chamber, fluid may be pressurized through a fluid connection attached to the stabilizing chamber. The fluid may be pressurized by, for example, a pump, in which the pump may be an external pump, such as located on a nearby vessel. For example, a flexible hose may be disposed at the upper end of the stabilizing chamber. This flexible hose may then be connected with the pump, in which the fluid may then be pressurized into the stabilizing chamber, such as within the ballasting compartment of the stabilizing chamber. Alternatively, though, rather than pressurizing fluid, the stabilizing chamber may instead receive "free flooding" fluid through the fluid connection. As such, the fluid connection may only need to be opened, in which the fluid connection would then provide the fluid to the stabilizing chamber without the need for pressurization.

After the stabilizing unit and the mobile offshore unit have been submerged to a desired level, the stabilizing unit may be disconnected from the mobile offshore unit. For example, after a majority portion of the stabilizing unit has been submerged with respect to the sea surface, such as by about 90% submersion, preferably the stabilizing unit is disconnected from the mobile offshore unit. The stabilizing chamber may be disconnected from the mobile offshore unit in a reverse analogous movement with respect to how the stabilizing chamber was removably connected to the mobile offshore unit. For example, assuming suspension cables or pins were used to removably connect the stabilizing chamber with the mobile offshore unit, these suspension cables or pins may then be removed.

As such, though the stabilizing chamber may require large mechanical machines, such as a crane, when connecting the stabilizing chamber to the mobile offshore unit, the stabilizing chamber may be disconnected from the mobile offshore unit without the need for or assistance from the large mechanical machines. Particularly, when the mobile offshore unit is positioned at the desired location, it may be difficult to have support from large mechanical moving devices, as the desired location is most likely offshore and several miles or kilometers from land. Further, not only would these mechanical moving devices be difficult to obtain, they may also be expensive to use in such offshore locations.

Accordingly, the stabilizing chamber may be filled with fluid such that the stabilizing chamber will further submerge and move vertically downward with respect to the mobile offshore unit. For example, after removing the suspension cables or pins from the supports, the stabilizing chamber may be further filled with fluid. As the stabilizing chamber receives fluid, the stabilizing chamber will further submerge and move vertically downward with respect to the mobile offshore unit. As such, the upper support of the stabilizing chamber will disengage the upper hull support of the mobile offshore unit, and the lower support of the stabilizing chamber will slidably disengage the lower hull support of the mobile offshore unit. After the supports have disengaged, the stabilizing chamber may easily be moved away from the mobile offshore unit, such as by having a vessel pull the stabilizing chamber away from the mobile offshore unit.

To remove fluid then from the stabilizing chamber, air may be pressurized through a fluid connection attached to the stabilizing chamber. The air may be pressurized by, for example, an air compressor, in which the air compressor may be external to the stabilizing chamber. When pressurized air is introduced into the stabilizing chamber, the other fluid, such as seawater, may be forced out of the stabilizing chamber. For example, the stabilizing chamber may include two fluid connections, as shown in FIG. 2B. Air may be pressurized and introduced into the first fluid connection 253, in which this pressurized air would force out water through the second fluid connection 255. Similar to above, a flexible hose may be disposed at the upper end of the stabilizing chamber to provide pressurized air. This flexible hose may then be connected to an air compressor, in which the air may be pressurized and provided to the stabilizing chamber.

Embodiments of the present disclosure may provide for one or more of the following advantages. First, embodiments disclosed herein may provide for a more economical alternative for increasing the stability of a mobile offshore unit. For example, rather than having to increase the width or lower the center of gravity of a mobile offshore unit to increase the stability of a mobile offshore unit, a stabilizing chamber in accordance with the present disclosure may be used. Further, embodiments disclosed herein may provide for a stabilizing chamber that is removably connected to a mobile offshore unit. For example, as described above, by using an upper support and a lower support, the stabilizing chamber may be connected and disconnected from the mobile offshore unit as desired. Furthermore, embodiments disclosed herein may provide for a stabilizing chamber that may be removed and disconnected from a mobile offshore unit without the need or assistance of a mechanical machine (such as a crane). For example, once offshore, the stabilizing chamber may still be disconnected from the mobile offshore unit, in which the stabilizing chamber may be easily moved away from the mobile offshore unit thereafter, by, for example, a vessel.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A stabilizing chamber to be used with a mobile offshore unit, the chamber comprising:

a housing having an upper end and a lower end, the housing configured to removably receive and retain fluid therein;

an upper support attached adjacent to the upper end of the housing; and a lower support attached adjacent to the lower end of the housing;

wherein the upper support and the lower support are attached on the same side of the housing;

wherein the upper support and the lower support are adapted to removably and re-attachably connect with the mobile offshore unit;

wherein the upper support is configured to support the weight of the chamber; and wherein the upper support comprises a hook connection member.

2. The chamber of claim 1, further comprising a divider disposed within the housing, wherein the divider forms a ballast compartment and a void compartment within the chamber.

3. The chamber of claim 2, wherein the void compartment is disposed above the ballast compartment, wherein the ballast compartment is configured to removably receive and retain fluid therein, and wherein the void compartment is sealed such that fluid is not received therein.

4. The chamber of claim 2, wherein a first fluid connection is disposed adjacent an upper end of the ballast compartment, and wherein a second fluid connection is disposed adjacent a lower end of the ballast compartment.

5. The chamber of claim 4, wherein the first fluid connection is configured to provide air to the ballast compartment, wherein the second fluid connection is configured to provide water to the ballast compartment.

6. The chamber of claim 1, wherein the housing is cylindrical and comprises at least one ring stiffener disposed within the housing and adjacent the inner wall of the housing.

7. The chamber of claim 1, further comprising at least one lifting connection member attached to the housing such that the chamber is adapted to engage a lifting device.

8. The chamber of claim 1, wherein the housing comprises steel and a wall thickness of about 0.80 in (20 mm).

9. A stabilizing chamber to be used with a mobile offshore unit, the chamber comprising:

a housing having an upper end and a lower end, the housing configured to removably receive and retain fluid therein;

an upper support attached adjacent to the upper end of the housing; and a lower support attached adjacent to the lower end of the housing;

wherein the upper support and the lower support are attached on the same side of the housing;

wherein the upper support and the lower support are adapted to removably connect with the mobile offshore unit;

wherein the upper support is configured to support the weight of the chamber; and wherein the upper support comprises a hook connection member and the lower support comprises a slidable connection member.

10. The chamber of claim 9, wherein the upper support is adapted to removably engage the mobile offshore unit, wherein the lower support is adapted to slidably engage the mobile offshore unit.

11. The chamber of claim 10, wherein the slidable connection member of the lower support is adapted to limit the vertical movement in at least one direction of the stabilizing chamber with respect to the mobile offshore unit.

12. A system to stabilize a mobile offshore unit, the system comprising:

a stabilizing chamber, comprising:

a housing configured to removably receive and retain fluid therein;

a first support and a second support attached to the same side of the housing; and the mobile offshore unit comprising:

a first hull support and a second hull support attached to the same side of the mobile offshore unit;

wherein the first support of the stabilizing chamber is configured to removably and re-attachably connect with the first hull support of the mobile offshore unit;

wherein the second support of the stabilizing chamber is configured to removably and re-attachably connect with the second hull support of the mobile offshore unit; and wherein the first support comprises a hook connection member.

13. The system of claim 12, wherein the first support of the stabilizing chamber and the first hull support are configured to support the weight of the stabilizing chamber.

14. The system of claim 13, wherein the first support is attached to the housing adjacent to an upper end of the housing, wherein the second support is attached to the housing adjacent to a lower end of the housing.

15. The system of claim 12, wherein the housing of the stabilizing chamber is cylindrical and comprises steel.

16. The system of claim 15, wherein at least one ring stiffener is disposed within the housing and adjacent the inner wall of the housing.

17. A system to stabilize a mobile offshore unit, the system comprising:

a stabilizing chamber, comprising:

a housing configured to removably receive and retain fluid therein;

a first support and a second support attached to the same side of the housing; and the mobile offshore unit comprising:

a first hull support and a second hull support attached to the same side of the mobile offshore unit;

wherein the first support of the stabilizing chamber is configured to removably and re-attachably connect with the first hull support of the mobile offshore unit;

wherein the second support of the stabilizing chamber is configured to removably and re-attachably connect with the second hull support of the mobile offshore unit;

wherein the first support of the stabilizing chamber and the first hull support are configured to support the weight of the stabilizing chamber;

wherein the first support is attached to the housing adjacent to an upper end of the housing;

wherein the second support is attached to the housing adjacent to a lower end of the housing;

wherein a hook connection member of the first support is configured to engage a corresponding hook connection member of the first hull support; and wherein a slidable connection member of the second support is configured to slidably engage a corresponding slidable connection member of the second hull support.

18. A method of stabilizing a mobile offshore unit, the method comprising:

providing a stabilizing chamber having a housing configured to removably receive and retain fluid therein;

removably connecting a first support of the stabilizing chamber to a first hull support of the mobile offshore unit;

removably connecting a second support of the stabilizing chamber to a second hull support of the mobile offshore unit;

wherein a hook connection member of the first support is configured to engage a corresponding hook connection member of the first hull support, and wherein a slidable connection member of the second support is configured to slidably engage a corresponding slidable connection member of the second hull support.

19. The method of claim 18, further comprising:

disposing fluid within the mobile offshore unit such that the mobile offshore unit descends with respect to the sea surface;

disposing fluid within the stabilizing chamber; and disconnecting the first support of the stabilizing chamber from the first hull support;

wherein the second support of the stabilizing chamber disconnects and slidably disengages the second hull support of the mobile offshore unit upon disconnection of the first support.

20. The method of claim 19, wherein the stabilizing chamber further comprises a divider disposed within the housing, wherein the divider forms a ballast compartment and a void compartment.

21. The method of claim 20, wherein fluid is disposed within the ballast compartment of the stabilizing chamber.

22. A method of manufacturing a stabilizing chamber, the method comprising:

providing a housing having an upper end and a lower end, the housing configured to removably receive and retain fluid therein;

attaching an upper support adjacent to the upper end of the housing; and attaching a lower support adjacent to the lower end of the housing;

wherein the upper support and the lower support are attached on the same side of the housing;

wherein the upper support is configured to support the weight of the stabilizing chamber;

wherein the upper support and the lower support of the stabilizing chamber are configured to removably and re-attachably connect with a mobile offshore unit; and wherein the upper support comprises a hook connection member.

23. The method of claim 22, further comprising:

disposing a divider within the housing such that the divider forms a ballast compartment and a void compartment within the stabilizing chamber.

* * * * *